US005675974A

United States Patent [19]

Heikrodt et al.

[11] Patent Number: 5,675,974

[45] Date of Patent: Oct. 14, 1997

[54] HEAT EXCHANGER

[75] Inventors: Klaus Heikrodt, Krefeld; Peter Hofbauer, Rösrath-Hoffnungsthal, both of Germany

[73] Assignees: Robert Bosch GmbH, Stuttgart; Viessmann Werke GmbH & Co., Allendorf am Eder, both of Germany

[21] Appl. No.: 525,710

[22] PCT Filed: Jan. 12, 1995

[86] PCT No.: PCT/EP95/00107

§ 371 Date: Sep. 15, 1995

§ 102(e) Date: Sep. 15, 1995

[87] PCT Pub. No.: WO95/00107

PCT Pub. Date: Jul. 20, 1995

[30] Foreign Application Priority Data

Jan. 18, 1994 [DE] Germany ..... 44 01 247.0

[51] Int. Cl.[6] ..... F25B 9/00

[52] U.S. Cl. ..... 62/6; 60/520

[58] Field of Search ..... 62/6; 60/520; 165/168, 165/170

[56] References Cited

U.S. PATENT DOCUMENTS

| | | | |
|---|---|---|---|
| 1,240,862 | 9/1917 | Lundgaard | 62/6 |
| 2,599,611 | 6/1952 | Clay | 60/517 |
| 2,688,228 | 9/1954 | Brey et al. | 60/24 |
| 4,386,505 | 6/1983 | Little | 165/168 |
| 4,392,362 | 7/1983 | Little | 165/168 |
| 4,489,570 | 12/1984 | Little | 165/168 |
| 4,774,808 | 10/1988 | Otters | 60/526 |
| 4,802,332 | 2/1989 | Beale | 60/520 |
| 4,984,428 | 1/1991 | Momose et al. | 60/517 |
| 5,267,611 | 12/1993 | Rosenfeld | 165/168 |

FOREIGN PATENT DOCUMENTS

| | | |
|---|---|---|
| 0114640 | 8/1984 | European Pat. Off. . |
| 0238707 | 9/1987 | European Pat. Off. . |
| 9506847 | 3/1995 | European Pat. Off. . |
| 946196 | 7/1956 | Germany . |
| 9678 | 10/1979 | Germany . |
| 14129 | 11/1980 | Germany . |
| 18458 | 10/1981 | Germany . |
| 3443085 | 6/1985 | Germany . |
| 4023327 | 1/1992 | Germany . |
| 4219583 | 6/1992 | Germany . |
| 9318354 | 9/1993 | Germany . |
| 4232555 | 4/1994 | Germany . |
| 58-25556 | 2/1983 | Japan . |
| 60-232496 | 11/1985 | Japan . |
| 62-168955 | 7/1987 | Japan . |
| 1244285 | 9/1989 | Japan . |
| 333671 | 2/1955 | Switzerland . |
| 136195 | 12/1919 | United Kingdom . |

OTHER PUBLICATIONS

Harvesting a Three Year Nuclear Crop; Sep. 12, 1958.

Hans–Detlev Kühl et al; Der Vuilleumier . . . Wärmepumpe; 1986; pp. 205–210.

*Primary Examiner*—Ronald C. Capossela

*Attorney, Agent, or Firm*—Robert W. Becker & Associates

[57] ABSTRACT

A heat exchanger wherein the media that take part in the heat transfer are separated from one another. To provide a compact heat exchanger that has a high efficiency, the heat exchanger is formed by a base body, one surface of which is provided with at least one groove that extends from the inlet to the outlet and that is sealed by a cover, in the form of a flow channel, for the heat-absorbing heat transfer medium. The other surface of the base body has a plurality of channels and/or pores for the heat-emitting medium.

8 Claims, 3 Drawing Sheets

HEAT EXCHANGER

BACKGROUND OF THE INVENTION

The invention relates to a heat exchanger, particularly for heating and cooling machines operating by a regenerative gas cycle process, with separated media which participate in the heat transfer.

Heating and cooling machines operating according to the Sterling or Vuilleumier cycle process have been known for a long time, for example, from GB-PS 136 195. However, despite the undeniable advantages of the regenerative gas cycle process, they have not found acceptance in practice, mainly because of constructive difficulties which have up to this point prevented the realization of the theoretical advantages of such machines in practice. Even recent publications, for example EP 0 238 707 A2, are more concerned with theoretical considerations than with practical embodiments of such heating and cooling machines provided with two pistons which are linearly displaceable within a pressure-resistant housing and which commonly delimit a warm working volume and with one of the pistons within the housing delimiting a hot working volume subjected to a heating source and the other piston delimiting a cold working volume, with the three working volumes being connected with one another via interposed regenerators and heat transfer elements and with a drive and/or control for the pistons being provided.

In order to realize industrial production of such heating and cooling machines past the stage of prototypes and suitable for daily use, it is necessary to optimize the individual components of these machines.

The object of the invention is to create a heat exchanger particularly suitable for heating and cooling machines operating by a regenerative gas cycle process, with a high efficiency and a small overall size, and also suitable for other applications.

SUMMARY OF THE INVENTION

The solution to this object according to the invention is characterized in that the heat exchanger has a base body that is provided at one of its surfaces with at least one groove that runs from the intake to the outlet and that is sealed by a cover to form a flow channel for the heat-absorbing, preferably liquid heat transfer medium, and the base body is provided at its other surface with a great number of channels and/or pores for the heat-emitting medium that preferably is a process gas.

The inventive embodiment provides a heat exchanger that can be produced to be provided with a small overall size, that makes an economic production possible and has a high efficiency despite the small overall size.

There are various possibilities for the embodiment of the channels and/or pores through which the heat-emitting medium flows. In one of the inventive embodiments the base body is provided with a number of grooves serving as channels for the heat emitting medium. At the same time such grooves enlarge the surface participating in the heat transfer. According to a further feature of the invention, the base body can alternatively be provided with a layer of a porous material. The heat emitting medium, a process gas in particular, flows through the pores of this layer of a preferably good heat conducting material. The layer can either be applied onto the base body or be produced as a separate member to be attached to the base body. In a further embodiment according to the invention, the channel for the heat emitting medium can be embodied by a member of flat, shaped and/or perforated metal sheets or by a metal mesh, woven wire, or metal tangle, with this member being arranged on the base body in a force fit or friction-tight manner. Such an inventive embodiment creates a particularly large surface participating in the heat transfer and, moreover, it generates a turbulent flow that increases heat transmission.

If the inventive heat exchanger is to be employed in a heating and cooling machine that operates by a regenerative gas cycle process of the aforementioned kind, it is proposed by the invention to embody the base body to be cylindrical and to arrange it within the cylindrical housing of the machine. According to the invention the housing of the machine can in this case serve as a cover of the groove that is provided at the one surface of the base body.

According to a further feature of the invention, the channels and/or pores for the process gas of the heating and cooling machine can be open toward the slot that is formed in conjunction with the mantle surface of the respective piston so that a particularly compact and economically fabricatable construction of the heat exchanger results. If the pistons of the heating and cooling machine have a larger diameter, the invention also provides the possibility to seal the channels and/or pores for the process gas toward the piston slot by a bushing in which case the bushing has to be provided in the area of the respective working volume of the machine with intake and outlet openings.

BRIEF DESCRIPTION OF THE DRAWINGS

In the drawing, various embodiments of an inventive heat exchanger are illustrated, namely it is shown in.

DESCRIPTION OF PREFERRED EMBODIMENTS

Figure 1:
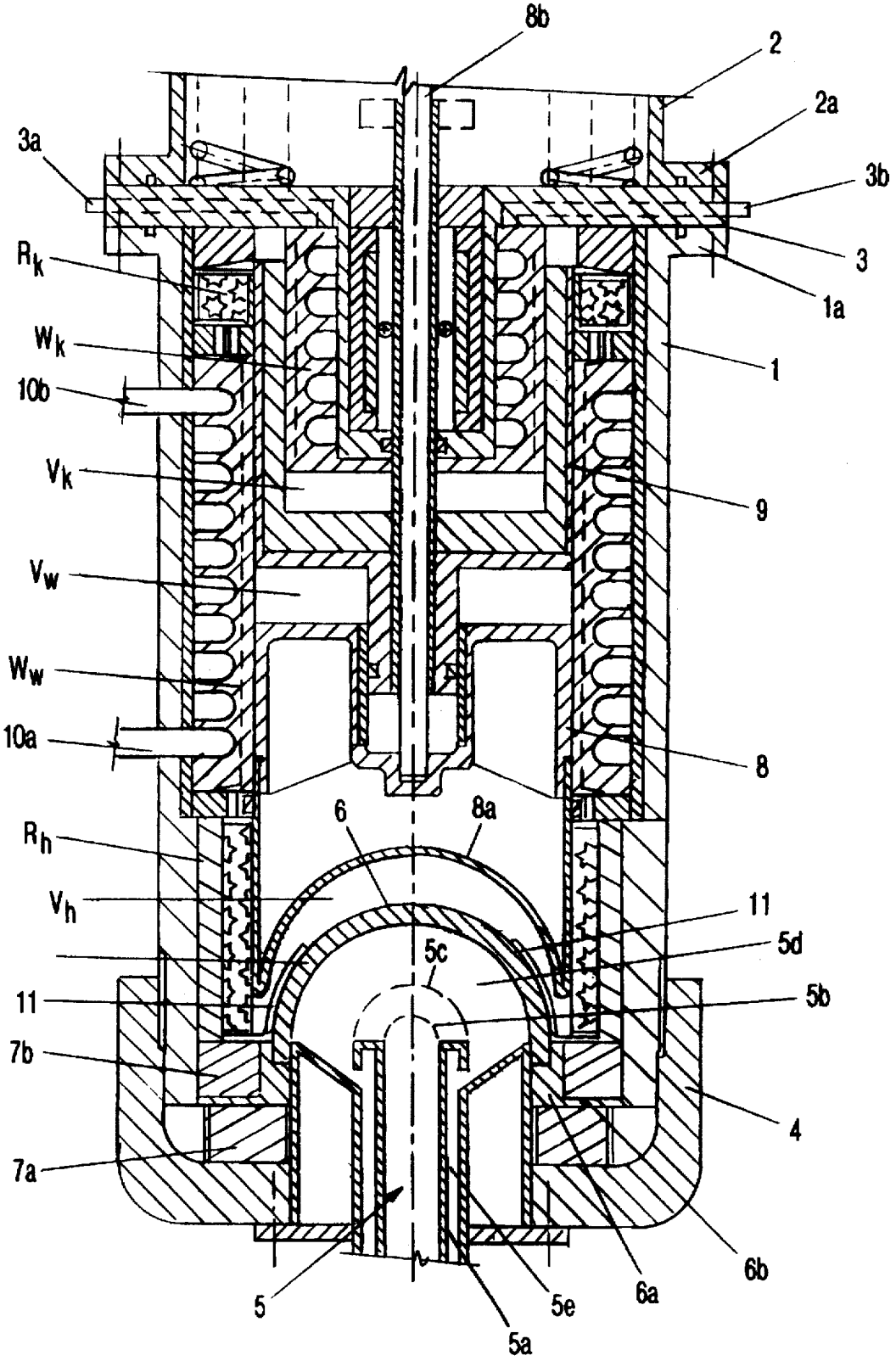
FIG. 1 a first embodiment of a heat exchanger inserted into a heating and cooling machine that operates by a regenerative gas cycle process, in longitudinal section of such a machine, FIG. 2 an enlarged front view of half of the heat exchanger provided within the hot portion of the machine according to FIG. 1, FIG. 3 an illustration of a heat exchanger along line III—III of FIG. 2, FIG. 4 front view corresponding to the upper portion in FIG. 2 of a second embodiment, FIG. 5 a longitudinal section of the upper half of the heat exchanger according to FIG. 4 along line V—V in FIG. 4, FIG. 6 a front view corresponding to FIG. 4 of a third embodiment, FIG. 7 a fourth embodiment of a heat exchanger corresponding to the illustration according to FIG. 4, respectively FIG. 6, and FIG. 8 a further illustration corresponding to FIGS. 4, 6, respectively 7 of a fifth embodiment.

FIG. 1 illustrates a first embodiment of the heat exchanger with the help of a longitudinal section of a heating and cooling machine operating by a regenerative gas cycle process. This machine comprises a pressure-tight housing 1 that is embodied as a circular cylinder and that is provided at its one end with a flange 1*a* onto which an engine housing 2 with a corresponding flange 2*a* is screwed. The engine housing 2 is only partly illustrated. In between the flanges 1*a* and 2*a*, a pressure-tight head 3 is provided which closes off the one end of the housing 1.

At the other end, the pressure-tight housing 1 is provided with a housing cover 4 that is screw-connected in the embodiment to the cylindrical housing 1 by threads and in the interior of which a heat generator 5 is provided in the form of a gas burner. This gas burner comprises a cylindrical supply tube 5*a* for the burnable gas that is provided with a proportioning hemispherical means 5*b*. A burner surface 5*c* made out of a special steel mesh that acts as a reacting surface is provided concentrically relative to this proportioning hemispherical means and delimits the gas inlet chamber and glows when the gas burner is operated so that the gas burner 5 emits a large amount of the generated heat by radiation. The developing flue gases are discharged from a combustion chamber 5*d* encompassing the hemispherical-shaped burner surface 5*c* via an exhaust gas tube 5*e* which concentrically encompasses the supply tube 5*a* of the gas burner 5.

The heat generated by the gas burner 5 is conveyed by radiation and convection to a dividing wall 6 that is embodied as a rotationally symmetrical vault, preferably as a conic section, as a hemisphere in the embodiment, and arches into the interior of the housing 1. In the embodiment the hemispherical vault arches at a uniform distance to the hemispherical burner surface 5*c* of the gas burner 5.

The dividing wall 6 being embodied as a portion of the pressure-resistant housing 1 is mounted on a supporting ring 6*a* that is connected with the end portion of the cylindrical housing 1 via a membrane-shaped extension 6*b*. In the embodiment, both connections are carried out by welding. By utilizing insulating rings 7*a* and 7*b* which are each arranged on either side of the membrane-shaped extension 6*b* toward the housing cover 4 on the one hand, and toward the housing 1 on the other hand, the heat dissipation from the dividing wall 6 heated by the gas burner 5, to the housing 1 and its housing cover 4 and thus to the environment, is considerably reduced.

The heat generated by the gas burner 5 and received by the dividing wall is being transferred from the inner surface of the dividing wall 6 to a working medium, preferably helium, which is provided in a hot working volume $V_h$. This hot working volume is delimited by the dividing wall 6 on the one hand and on the other hand by the piston head 8*a* of a piston 8 that is linearly displaceably arranged within the housing 1. This piston 8 is connected via a piston rod 8*b* to an engine, respectively a control, not illustrated in the drawing, which are mounted within the engine housing 2.

The piston 8 in conjunction with a further piston 9 delimits a warm working medium $V_w$. The piston 9 which is also guided to be linearly displaceable within the housing 1, finally delimits in its interior a cold working volume $V_k$. These three volumes are connected with one another via interposed regenerators $R_h$, $R_k$ and by heat transfer elements $W_w$, $W_k$. The regenerator $R_h$ provided within the hot portion of the housing 1, stores, during the course of the regenerative gas cycle process, a portion of the heat transferred to the hot working volume $V_h$; the regenerator $R_k$ that is provided within the cold portion of the housing 1 carries out the corresponding function with regard to the cold working volume $V_k$.

Via a channel 3*a* within the head 3, a medium from the environment is, continuously supplied to the heat transfer element $W_k$ that is fixedly mounted in the embodiment on the head 3 within the cold piston 9 and it is conveyed back to the environment via a tubing 3*b* after a portion of its caloric content has been utilized. The heat transfer element $W_w$ is supplied via connecting lines 10*a*, 10*b* with a heat transfer medium, the heating-up of which serves for power generation if the machine is used as a heating machine. A conducting plate 11 arranged in the marginal area of the dividing wall 6 serves to improve the heat transmission from the dividing wall 6 to the working medium in the hot working volume $V_h$. The conducting plate 11 forms flow channels with a small cross-section of flow so that the working medium leaving the hot working volume $V_h$ is guided across the marginal area of the dividing wall 6 at a high velocity of flow before the working medium enters the regenerator $R_h$.

Figure 2:
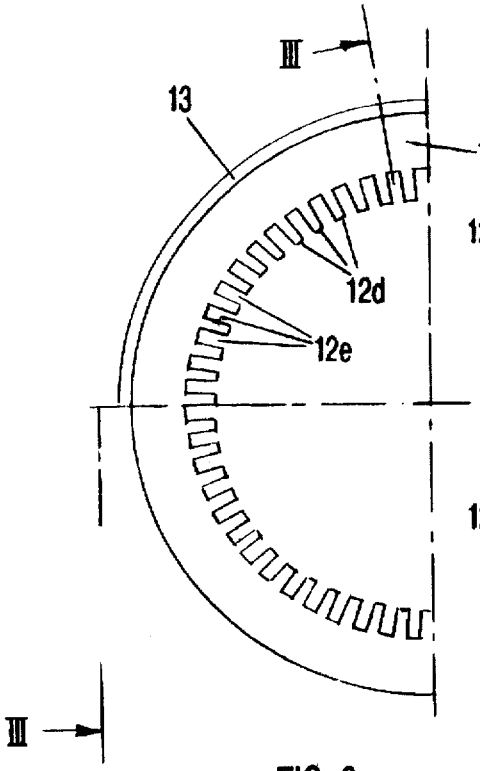
Figure 3:
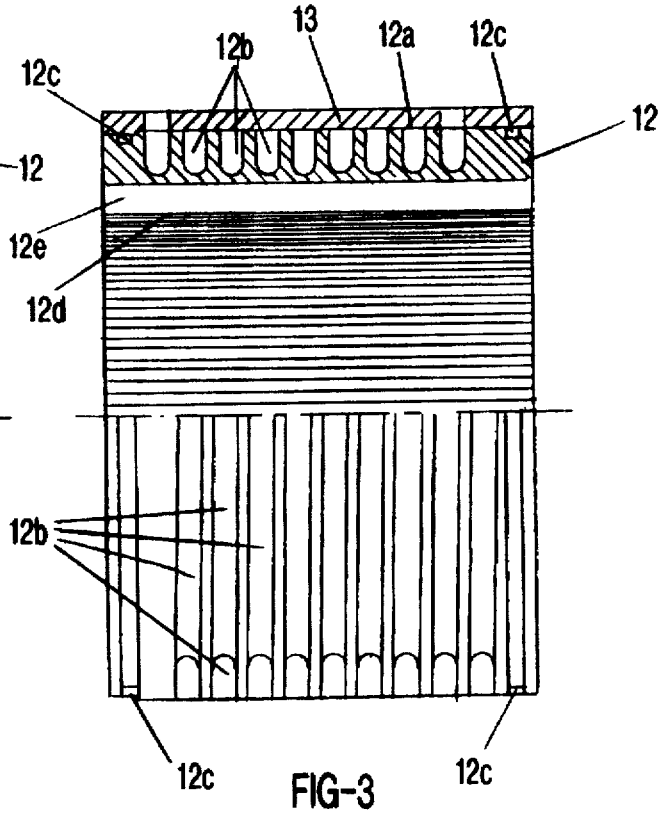

The heat transfer element $W_w$ illustrated enlarged and as a single part in FIGS. 2 and 3, comprises a base body 12 that is provided on its surface 12*a* facing the housing, according to FIG. 3, with at least one groove 12*b* running from the intake to the outlet of the heat transfer element $W_w$. In the embodiment according to FIGS. 2 and 3, this groove 12*b* is formed as a single-thread spiral with nine windings in the embodiment, the beginning and the end of the windings being provided with the connecting lines 10*a*, respectively 10*b* for the liquid heat transfer medium. The spiral shape of the groove 12*b* that cannot be recognized in the upper half of FIG. 3 due to the cross-sectional illustration, can be clearly recognized from the non-sectional view of the lower portion in FIG. 3. In order to embody the spiral groove 12*b* of the base body 12 as a flow channel for the heat-absorbing heat transfer medium, the surface of the base body 12 that faces the housing is sealed by a covering means 13 that has been omitted in the lower half of FIGS. 2 and 3 in order to illustrate the spiral course of the groove 12*b*. In order to achieve a reliable sealing action between the base body 12 and the covering means 13, circular grooves 12*c* are provided in the embodiment in the vicinity of the end faces of the base body 12, for a seal that is not illustrated in the drawing. The covering means 13 can be a separate member, preferably out of a heat-insulating material, but it can also be the housing 1 of the machine according to FIG. 1.

At its other surface 12*d*, positioned at its interior in the embodiment according to FIGS. 2 and 3, the base body 12 is provided with a great number of channels and/or pores for the heat-emitting medium, preferably embodied by a process gas. In the first embodiment according to FIGS. 2 and 3, for this purpose a great number of axial grooves 12*e* is provided, which are open in this case toward the interior of the heat exchanger since the necessary limitation is in each case formed by the pistons 8, respectively 9 which are illustrated in FIG. 1.

Figure 4:
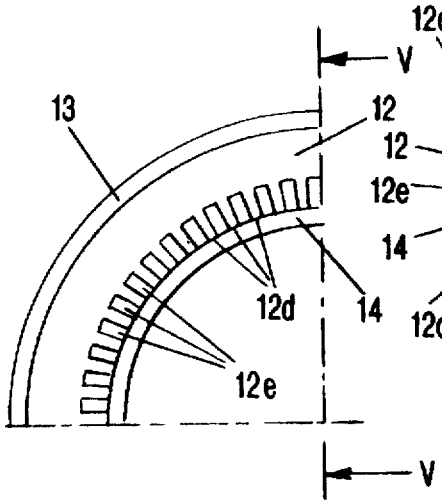
Figure 5:
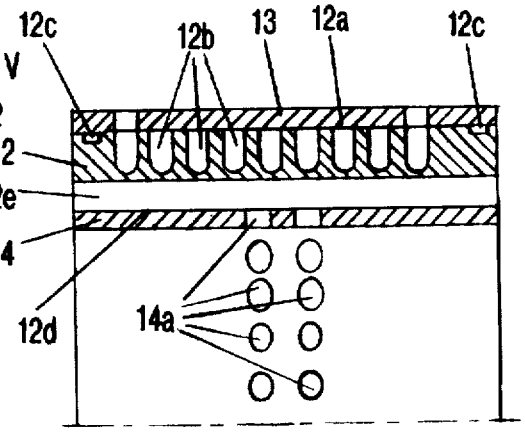

The second embodiment of a heat exchanger illustrated in FIGS. 4 and 5 differs from the first embodiment according to FIGS. 2 and 3 by the fact that the axial grooves 12*e* are closed off by a bushing 14 that is provided with intake and outlet openings 14*a* in the area of the warm working volume $V_w$ of the machine according to FIG. 1.

Figure 7:
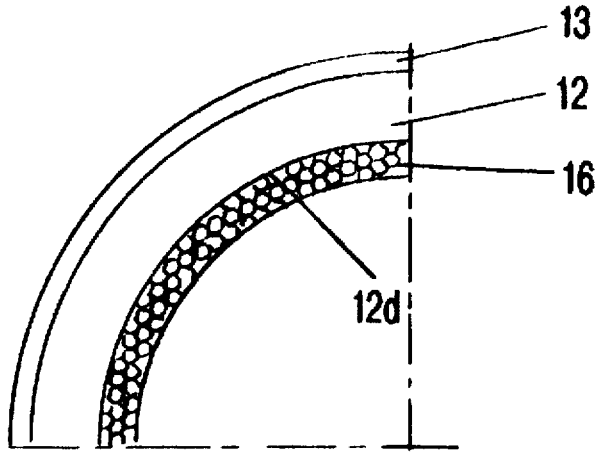
Figure 6:
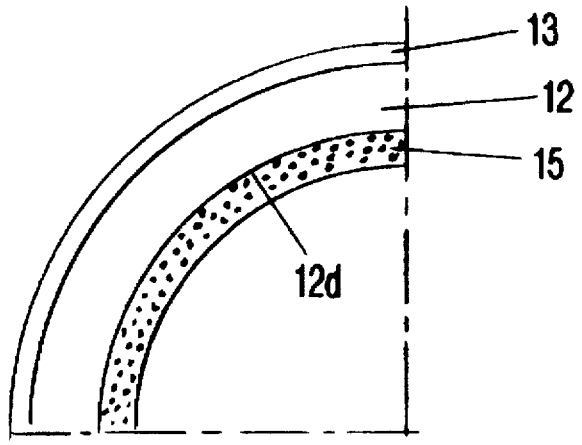
Figure 8:
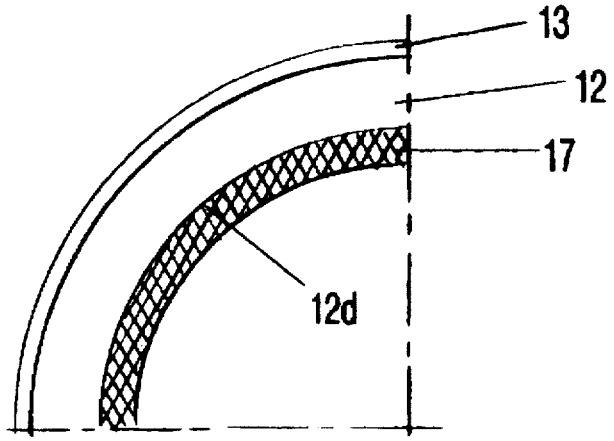

The third embodiment according to FIG. 6 illustrates that the base body 12 can, instead of being provided with axial grooves 12*e* for the process gas, also be provided at its interior surface 12*d* with a layer 15 of a porous material through the pores of which the heat-emitting process gas flows. Instead of such a layer 15 of a porous material, the channels for the process gas can, according to FIG. 7, also be formed by a member 16 out of shaped or perforated metal sheets, or according to FIG. 8, by a member 17 out of a metal mesh, woven wire or metal tangle. In both cases, the member 16, respectively 17 is arranged at the base body 12 force fit or friction-tightly so that a good heat transfer between the respective body 16, respectively 17 and the base body 12 results.

In all illustrated embodiments, a heat exchanger is presented that has a small construction volume, that can be produced cost-efficiently, and has a high heat exchange efficiency. Such a heat exchanger is not only suitable for application in heating and cooling machines which operate by a regenerative gas cycle process but can also be applied for other heat transfer processes, for example, in the chemical industry.

The present invention is, of course, in no way restricted to the specific disclosure of the specification and drawings, but also encompasses any modifications within the scope of the appended claims.

Reference Numerals

1 housing
1*a* flange
2 engine housing
2*a* flange
3 head
3*a* channel
3*b* channel
4 housing cover
5 gas burner
5*a* supply tube
5*b* proportioning hemispherical means
5*c* burner surface
5*d* combustion chamber
5*e* exhaust gas tube
6 dividing wall
6*a* supporting ring
6*b* extension
7*a* insulating rings
7*b* insulating rings
8 piston
8*a* piston head
8*b* piston rod
9 cold piston
10*a* connecting line
10*b* connecting line
11 conducting plate
12 base body
12*a* surface
12*b* groove
12*c* circular groove
12*d* surface
12*e* axial groove
13 covering means
14 bushing
14*a* intake and outlet opening
15 layer
16 member (out of steel)
17 member (out of metal mesh)
$V_h$ hot working volume
$V_w$ warm working volume
$V_k$ cold working volume
$R_h$ hot regenerator
$R_k$ cold regenerator
$W_w$ heat transfer element
$W_k$ heat transfer element

We claim:

1. A heat exchanger wherein the the heat-emitting medium and the heat-absorbing medium that take part in heat transfer are separated from one another, comprising:

a base body having inlet and outlet means, said base body having a first surface that is provided with at least one groove that extends from said inlet means to said outlet means, said base body having a second surface that is provided with a plurality of passage means for said heat-emitting medium;

a cover means that seals said at least one groove to thereby form a flow channel for said heat-absorbing medium.

2. A heat exchanger according to claim 1, wherein said passage means comprise a plurality of grooves as channels in said second surface of said base body.

3. A heat exchanger according to claim 1, wherein said passage means is formed by a layer of porous material.

4. A heat exchanger according to claim 1, wherein said passage means is selected from the group consisting of flat, shaped, and perforated metal sheets, a metal mesh, woven wire, and metal tangle disposed in a positive manner on said second surface of said base body.

5. A heat exchanger according to claim 1, for use in heating and cooling machines that operate according to a regenerative gas cycle process, wherein said base body is cylindrical and is disposed in a cylindrical housing of such a machine.

6. A heat exchanger according to claim 5, wherein said housing forms said cover means for said at least one groove of said first surface of said base body.

7. A heat exchanger according to claim 5, wherein such a machine includes piston means within said housing, wherein a gap is provided between a mantle surface of said piston means and said second surface of said base body, and wherein said passage means are open relative to said gap.

8. A heat exchanger according to claim 5, wherein such a machine includes piston means within said housing, wherein a gap is provided between a mantle surface of said piston means and said second surface of said base body, and wherein said passage means are sealed relative to said gap by a bushing that in the region of a working chamber is provided with inlet and outlet openings.

* * * * *